United States Patent [19]

Bock

[11] Patent Number: 4,760,791

[45] Date of Patent: Aug. 2, 1988

[54] ELECTRICAL SEQUENTIAL FIRING SYSTEM

[75] Inventor: Immo E. Bock, Vandia Grove, South Africa

[73] Assignee: Johannesburg Construction Corp. Limited, Transvaal Province, South Africa

[21] Appl. No.: 79,670

[22] Filed: Jul. 30, 1987

[51] Int. Cl.[4] ..... F42D 1/04

[52] U.S. Cl. ..... 102/200; 102/217

[58] Field of Search ..... 102/200, 206, 217; 361/248, 249

[56] References Cited

U.S. PATENT DOCUMENTS

| | | | |
|---|---|---|---|
| 3,262,388 | 7/1966 | McCarty | 102/217 |
| 4,099,467 | 7/1978 | MacKellar et al. | 102/217 |
| 4,314,507 | 2/1982 | Seligmann | 102/217 |
| 4,489,655 | 12/1984 | Molnar | 102/217 |
| 4,610,203 | 9/1986 | Bock | 102/217 |

*Primary Examiner*—Charles T. Jordan

*Attorney, Agent, or Firm*—Harness, Dickey & Pierce

[57] ABSTRACT

This invention provides modules and a system for sequentially activating a series of detonators. The modules and the system rely on a transistor in which the base-collector junction is caused to change state by a current pulse of suitable magnitude so that it presents a low resistance. Similarly, the base-emitter junction is also caused to change state to present a low resistance path in both directions. Such transistors are utilized to steer signals through a module in which they are used to activate a detonator associated with that module and then to steer a further signal to a next module in the series.

33 Claims, 3 Drawing Sheets

ELECTRICAL SEQUENTIAL FIRING SYSTEM

This invention relates to an electrically operable sequential activation module and system. In particular the invention relates to a module and system for sequentially activating a device that has a low resistance prior to being activated and a high resistance thereafter. A device of this type is a detonator.

Various sequential blasting systems are known and the most relevant is that described in applicants U.S. Pat. No. 4,610,203. This earlier patent describes modules in which transistors are converted from a semi-conductor state to a conducting or non-conducting state. These transistors are utilized as two terminal devices. The applicant has found that transistors can be used as three terminal devices, with various junctions being converted from a semi-conducting state to a conducting state with advantageous results.

According to a first aspect of the invention there is provided an electrically operable sequential activation module for supplying an activating signal to a device which has a low resistance prior to being activated and a high resistance thereafter, the module being connectable in a series with other similar modules to sequentially activate a number of devices, the module including a first convertible element which has three terminals and in its normal first state has a high resistance in at least one direction between its first terminal and its second terminal and which changes to a second state in which it has a low resistance in both directions between its first and second terminals when a first signal having a predetermined characteristic is applied across the first and second terminals, the first element thereafter having the low resistance value in both directions between the first and second terminals when the first signal is removed and the first element further having in its normal first state a high resistance in at least one direction between its first terminal and its third terminal, the first element changing to a third state in which it has a low resistance in both directions between its first and third terminals when a second signal having a predetermined characteristic is applied across the first and third terminals, the first element thereafter having the low resistance value in both directions between the first and third terminals when the second signal is removed;

a first power terminal connectable to an electrical power source for supplying the first signal, the second signal and the activating signal;

a first and a second device terminal by means of which the device is connectable to the module;

an input steering terminal; and an output steering terminal which is connectable to the input steering terminal of a succeeding module in a series thereof;

with the first device terminal being connected to the input steering terminal;

the second device terminal being connected to the first terminal of the first element;

the second terminal of the first element being connected to the first power terminal; and the third terminal of the first element being connected to the output steering terminal.

According to a second aspect of the invention, there is provided an electrically operable sequential activation module for supplying an activating signal to a device which has a low resistance prior to being activated and a high resistance thereafter, the module being connectable in a series with other similar modules to sequentially activate a number of devices, the module including a first convertible element which has three terminals and in its normal first state has a high resistance in at least one direction between its first terminal and its second terminal and which changes to a second state in which it has a low resistance in both directions between its first and second terminals when a first signal having a predetermined characteristic is applied across its first and second terminals, the first convertible element thereafter having the low resistance value in both directions between its first and second terminals when the first signal is removed and the first convertible element further having in its first state, a high resistance in at least one direction between its first terminal and its third terminal, the first convertible element changing to a third state in which it has a low resistance in both directions between its first and third terminals when a second signal having a predetermined characteristic is applied across its first and third terminals, the first convertible element thereafter having the low resistance value in both directions between its first and third terminals when the second signal is removed;

a second convertible element which also has three terminals and in its normal first state has a high resistance in at least one direction between its first terminal and its second terminal and which changes to a second state in which it has a low resistance in both directions between its first and second terminals when the second signal is also applied across its first and second terminals, the second convertible element thereafter having the low resistance value in both directions between its first and second terminals when the second signal is removed and the second convertible element further having in its first state a high resistance in at least one direction between its first terminal and its third terminal, the second convertible element changing to a third state in which it has a low resistance in both directions between its first and third terminals when a third signal having a predetermined characteristic is applied across its first and third terminals, the second convertible element thereafter having the low resistance value in both directions between its first and third terminals when the third signal is removed;

a first signal steering element for steering the second signal to the first and third terminals of the first element and to the first and second terminals of the second convertible element;

a second signal steering element for steering the third signal to the first and third terminals of the second convertible element;

a first bypass element for passing the second signal past a device that has been activated;

a first and second power terminal connectable to an electrical power source for supplying the first, second, third and activating signals;

a first and a second device terminal by means of which the device is connectable to the module;

an input steering terminal; and an output steering terminal which is connectable to the input steering terminal of a succeeding module in a series thereof; with the first signal steering element being connected between the input steering terminal and the first terminal of the first convertible element;

the first device terminal being connected to the second terminal of the first convertible element;

the second device terminal being connected to the first power terminal;

the first bypass element being connected between the first and second device terminals;

the second signal steering element being connected between the third terminal of the first convertible element and the first terminal of the second convertible element;

the second terminal of the second convertible element being connected to the second power terminal; and the third terminal of the second power terminal being connected to the output steering terminal.

It will be appreciated that the first and second signals of the first aspect of the invention and the first, second and third signals of the second aspect of the invention may each be composite signals. Further, the activating signal may also be a discrete signal or it may form part of the first signal. Furthermore, the first, second, third and activating signals may either be voltage or current signals.

The first convertible element in the module in accordance with both the first aspect and the second aspect may have a low resistance from its first terminal to its second terminal and a high resistance in the opposite direction in its first state. Similarly, the first convertible element must have a low resistance from its first terminal to its third terminal and a high resistance in the opposite direction in its first state. The second convertible element in the second aspect of the invention may be similar, such that it has a low resistance from its first terminal to its second and from its first terminal to its third terminal, with a high resistance in the opposite direction in both cases, in its first state.

The module in accordance with the first aspect may include a fusible link in series with either one of the device terminals, the link being fusible by the activation signal. Thus the link may be connected between the input steering terminal and the first device terminal, or between the second device terminal and the first terminal of the convertible element. As indicated above, the activation signal may be included in the first signal. Further as indicated above, the first signal may be a composite signal, and it may accordingly have a fusing portion which is of a larger magnitude than a preceding portion, which causes the link to fuse.

The module in accordance with the first aspect may also include a bypass element for passing the first signal to the first element if a device is not connected between the device terminals. This bypass element is accordingly connected between the device terminals such that, in use, it is in parallel with the device.

In regard to the module according to the second aspect, the first signal steering element may also be fusible, such that it normally has a low resistance and is fused by the first signal (or a fusing portion thereof) to thereafter present a high resistance. Alternatively, the first signal steering element may be unidirectional, allowing a signal to pass in one direction only.

Similarly, the second signal steering element may also be fusible, to be fused by the second signal or a fusing portion thereof.

As far as the first bypass element is concerned it also may be unidirectional so that a signal is allowed to pass in one direction only. Alternatively, it may have a breakdown characteristic such that it allows a signal to pass if a predetermined voltage value is attained.

The module according to the second aspect may also include a blocking element which is connected in series with the second signal steering element for blocking the first signal from being supplied to the second convertible element when the modules are connected in a series as will be explained below. The blocking element may also have a breakdown characteristic such that is allows a signal to pass if a predetermined voltage is attained.

Still further in regard to the module in accordance with the second aspect, it may include a second bypass element for passing the first signal to the first convertible element if the device is not connected between the device terminals, the second bypass element being connected between the device terminals in parallel with the first bypass element. The second bypass element may also have a breakdown characteristic such that it allows a signal to pass if a predetermined voltage is attained.

The first and second convertible elements may be of a semi-conductor material. These elements may each have two junctions and may particularly be bi-polar transistors, the base terminals thereof comprising the first terminals. It will be appreciated by those skilled in the art that leads for the transistors could constitute the fusible links or elements.

Further according to the first aspect of the invention there is provided an electrically operable sequential activation system, which includes a number of modules in accordance with the first aspect of the invention and as described above, arranged in a series with the input steering terminal of each module other than the first module being connected to the output steering terminal of the preceding module and with the modules being arranged in two groups, with the modules of the groups alternating, and with the first power terminals of the first group being interconnected, and with the first power terminals of the second group being interconnected.

Further according to the second aspect of the invention there is provided an electrically operable sequential activation system which includes a plurality of modules in accordance with the second aspect of the invention as described above, arranged in a series with the first power terminals of the modules being interconnected, the second power terminals of the modules being interconnected, and with the input steering terminal of each module other than the first module in the series being connected to the output steering terminal of the preceding module.

A device may be connected to the device terminals of each module in the series.

The system may include an electrical power source for supplying the various signals. Thus, the power source for the system in accordance with the first aspect may supply a series of groups of first, second and activating signals, the polarity of each group of signals reversing, the power source being connected between the first power terminals of the first and second group of modules. With the system according to the second aspect, the power source may supply a series of groups of first, second and activating signals, the first signal of each group after the first constituting the third signal for a preceding group.

With the system according to the first aspect, the input steering terminal of the first module in the series may be connected to the first power terminal of the second module. Similarly, with the system according to the second aspect, the input steering terminal of the first module may be connected to its second power terminal.

The invention is now described, by way of examples, with reference to the accompanying drawings, in which.

Figure 1:
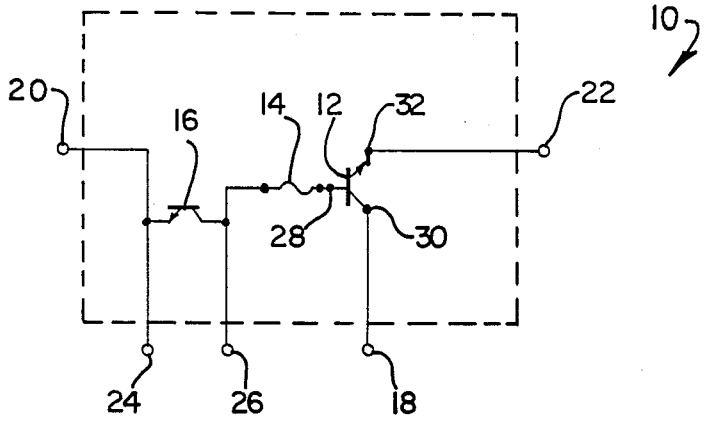
FIG. 1 shows schematically an electrically operable sequential activation module in accordance with the first aspect of the invention.

Referring to FIG. 1, an electrically operable module for sequentially activating a detonator, is designated generally by reference numeral 10. The module 10 has a first convertible element 12 in the form of an NPN bi-polar transistor, a fusible link 14 and a bypass element 16 which is also in the form of an NPN bi-polar transistor with only its emitter and collector being used. The module 10 further has a first power terminal 18, an input steering terminal 20, an output steering terminal 22, a first device terminal 24 and a second device terminal 26.

It will be noted that the input steering terminal 20 is connected to the first device terminal 24 and that the fusible link 14 is connected between the second device terminal 26 and a first terminal of the transistor 12, being its base terminal 28. The collector of the transistor 16 is connected to the second device terminal 26 and its emitter is connected to the first device terminal 24 so that it is in parallel with these terminals. Further, the collector of the transistor 12, which constitutes a second terminal 30 thereof, is connected to the first power terminal 18. Similarly, the emitter of the transistor 12, which constitutes a third terminal 32 thereof is connected to the output steering terminal 22.

It will be appreciated that in its normal state, the transistor 12 presents a low resistance between its base 28 and collector 30 and between its base 28 and emitter 32. Similarly, there is a high resistance between the collector 30 and the base 28 on the one hand and between the emitter 32 and the base 28 on the other hand.

The transistor 12 is designed so that if a current of suitable magnitude is caused to flow from the base 28 to the collector 30 a low resistance path is formed therebetween so that there is a low resistance between the base 28 and collector 30 in both directions after the current is removed. The situation is the same as far as the base 28 and emitter 32 are concerned, so that a low resistance path is formed between the base 28 and emitter 32 when a current of a suitable magnitude is caused to flow from the base 28 to the collector 30.

It will be understood that the transistor 16 will break down if the voltage across it rises to a suitable value, with the first device terminal 24 being positive with respect to the second device terminal 26. Thus, if there is no detonator connected between the terminals 24, 26 or if the detonator is defective, or if the connection is bad, then the transistor 16 will break down and allow current to flow between the input steering terminal 20 and the first power terminal 18.

It will further be understood that the link 14 is fused by a current of a suitable magnitude once a detonator connected to the device terminals 24 and 26 is activated, so that the transistor 12 is isolated from its associated detonator and its input steering terminal 20.

Figure 2:
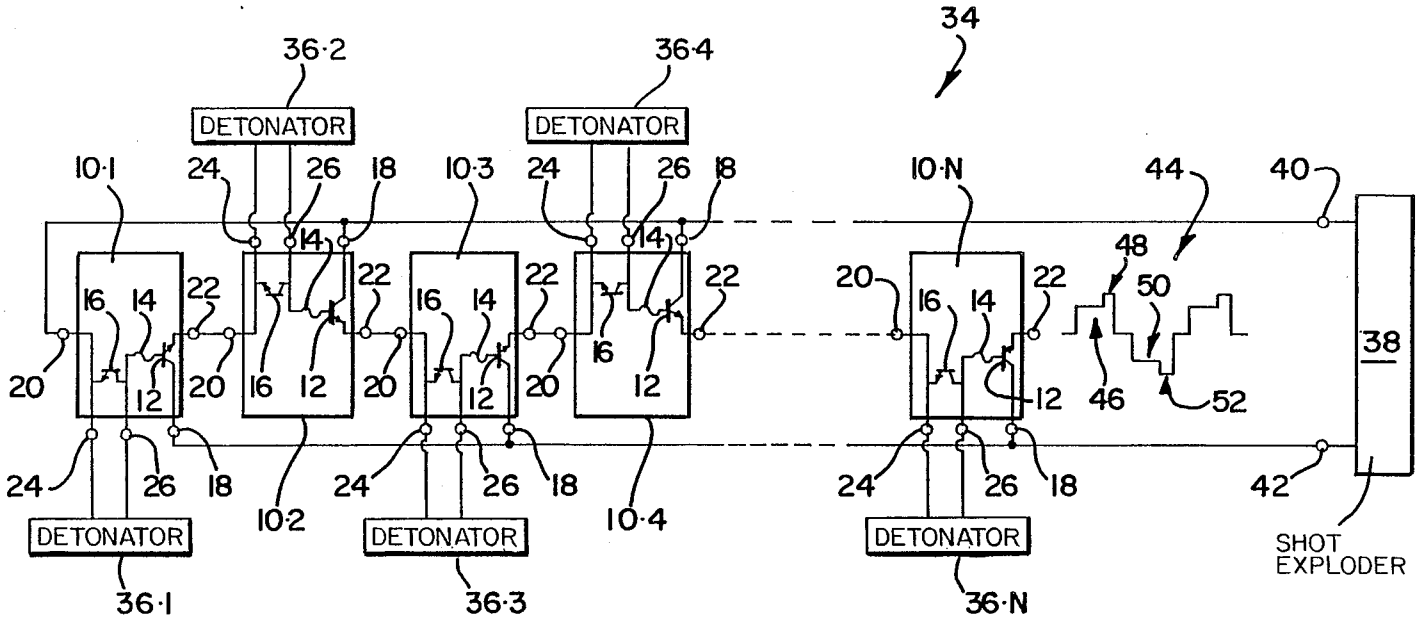
FIG. 2 shows schematically an electrically operable sequential activation system in accordance with the first aspect of the invention.

Reference is now made to FIG. 2, in which an electrically operable system for sequentially activating a number of detonators, is designated generally by reference numeral 34. The system 34 utilises a number of the modules 10 shown in FIG. 1, the modules being designated by the use of suffixes. Thus, there are N modules utilised, modules 10.1, 10.2, 10.3, 10.4 and 10.N being designated in FIG. 2. A detonator 36 is connected to the device terminals 24 and 26 of each of the modules 10.1 to 10.N, the detonators being designated by reference numerals 36.1 to 36.N. It will be seen that modules 10.1 to 10.N are connected in a series, with the input steering terminal 20 of each module other than the first module 10.1, being connected to the output steering terminal 22 of the preceding module. It will further be noted that the modules 10.1 to 10.N are arranged in two groups. The first group comprises the odd numbered modules, and the second group comprises the even numbered modules. Further, the first power terminals 18 of the odd numbered modules are connected together and the first power terminals 18 of the even numbered modules are connected together. Further, the input steering terminal 20 of the first module 10.1 is connected to the first power terminal 18 of the second module 10.2. The series of modules is connected to a shot exploder 38 which has a pair of terminals 40 and 42. The first power terminals 18 of the even numbered modules are connected to the terminal 40 and the first power terminals 18 of the odd numbered modules are connected to the other terminal 42. It will accordingly be appreciated that successive modules are reversed in polarity.

The shot exploder 38 provides a series of current pulses as shown at 44. Thus, the shot exploder 38 provides a first current pulse 46 with terminal 40 being positive with respect to terminal 42, then a further pulse 48 that is the same polarity as pulse 46 but of greater magnitude; a further pulse 50 which is similar to the pulse 36 but with reversed polarity such that the terminal 42 is positive with respect to the terminal 40; a further pulse 52 which is the same polarity as the pulse 50 and of the same magnitude as the pulse 48. These series of pulses is then repeated.

It will be appreciated that when the initial pulse 46 is provided, current flows through the input steering terminal 20 of the first module 10.1, through its associated detonator 36.1, through the link 14 and through the transistor 12 of the first module 10.1, back to the shot exploder 38 via the first power terminal 18 of the first module 10.1. This current pulse 46 activates the detonator 36.1 and causes the low resistance path to be formed between the base and collector of the transistor 12. If the detonator 36.1 is faulty or is not connected, then as indicated above, the transistor 16 provides a path for the current pulse 46. The current pulse 48 then causes the link 14 of the first module 10.1 to fuse into an open circuit state.

It will thus be understood that the next current pulse 50 which constitutes the second signal referred to above in regard to the first aspect of the invention as far as the first module 10.1 is concerned, passes through the transistor 12 of the first module 10.1 and then through the detonator 36.2 of the second module 10.2 and the second module 10.2, so that it also constitutes the first signal as far as the second module 10.2 is concerned. This current pulse 50 causes a short circuit path to be formed between the base and emitter of the transistor 12 of the first module 10.1 and also causes a low resistance path to be formed between the base and collector of the transistor 12 of the second module 10.2, at the same time activating the detonator 36.2. The next current pulse 52 causes the link 14 of the second module 10.2 to fuse, so that preceding portions of the system 34 are isolated. It will thus be appreciated that with the pulse 50, if the link 14 of the first module 10.1 had not fused, there would be a low resistance path through the input steering terminal 20 of the first module 10.1 which is not desired.

Figure 3:
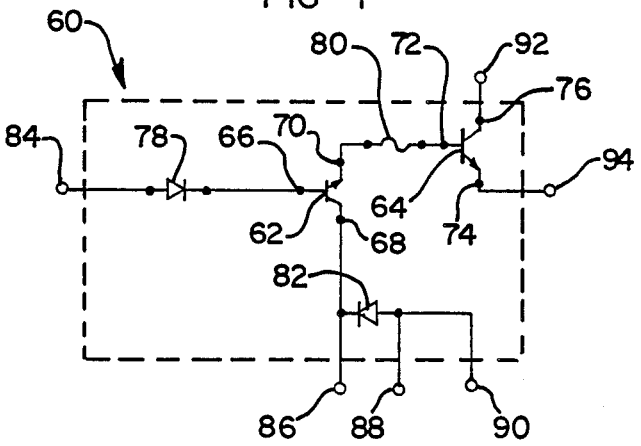
FIGS. 3 and 4 show in a schematic form, two embodiments of an electricaly operable sequential activation module in accordance with the second aspect of the invention.

Referring now to FIG. 3, an embodiment of a module for sequentially activating a detonator in accordance with the second aspect of the invention is designated generally by reference numeral 60. This module 60 is similar to the module 10 shown in FIG. 1 in that it utilises transistors 62 and 64 which have the same characteristics and properties as the transistor 12 which have been described and discussed above. Thus, the transistor 62 has a first terminal (the base) 66, a second terminal (the collector) 68 and a third terminal (the emitter) 70. The transistor 64 has three similar terminals 72, 74 and 76. The module 60 further has a first signal steering element 78 in the form of a diode, a second signal steering element 80 in the form of a fusible link and a first bypass element 82 also in the form of a diode. Further, the module 60 has an input steering terminal 84, device terminals 86 and 88, a first power terminal 90, a second power terminal 92 and an output steering terminal 94.

It will be seen that the diode 78 is connected between the input steering terminal 84 and the base terminal 66 of the transistor 62; the device terminal 86 is connected to the collector terminal 68 of the transistor 62; the other device terminal 88 is connected to the first power terminal 90; the diode 82 is connected between the device terminals 86 and 88; the fusible link 80 is connected between the emitter terminal 70 of the transistor 62 and the base terminal 72 of the transistor 64; the collector terminal 76 of the transistor 64 is connected to the second power terminal 92; and the emitter terminal 74 of the transistor 64 is connected to the output steering terminal 94.

In use, the modules 60 are connected in a series in a similar manner to that shown in FIG. 5 which shows a series of the modules shown in FIG. 4 and which will be discussed below. It will however be noted that the modules 60 are connected in a similar manner to the modules 10 in that the output steering terminal 94 of each module is connected to the input steering terminal 84 of the next module. However, the modules 60 are connected with the same polarity and not with alternating polarity as with the modules 10. Thus, a first current pulse is supplied to the input steering terminal 84 of a first module in the series, and this current pulse passes through the diode 78, from the base 66 to the collector 68 of the transistor 62, through a detonator connected to the terminals 86 and 88 and then out through the first power terminal 90. This current pulse causes the detonator to be activated and also creates a low resistance path between the base 66 and collector 68 of the transistor 62. A current pulse of reverse polarity is then supplied to the first power terminal 90, which passes through the diode 82, from the collector 68 to the base 66 of the transistor 62 and then through the emitter 70 of the transistor 62, the link 80 and from the base 72 to the collector 76 of the transistor 64, exiting at the second power terminal 92. This second pulse of reverse polarity creates a low resistance path between the base 66 and emitter 70 of the transistor 62 and also between the base 72 and the collector 76 of the transistor 64. This current pulse may also be of a suitable value to fuse the link 80. Although preferably, a fusing pulse of slightly greater magnitude, as is described above with reference to FIG. 2, may be utilised to fuse the link 80. A further current pulse, which has the same polarity as the first pulse, is then supplied to the second power terminal 92. This current pulse is the third signal referred to in the introduction above with regard to the second aspect of the invention, insofar as the module under discussion is concerned and also constitutes the first signal for a next module in the series. Thus, this pulse under discussion passes through the transistor 64 due to the open circuit presented by the fused link 80, creating a low resistance path between the base 72 and emitter 74 of the transistor 64 as well as acting on the transistor 62 of a succeeding module, and the detonator associated therewith.

Figure 4:
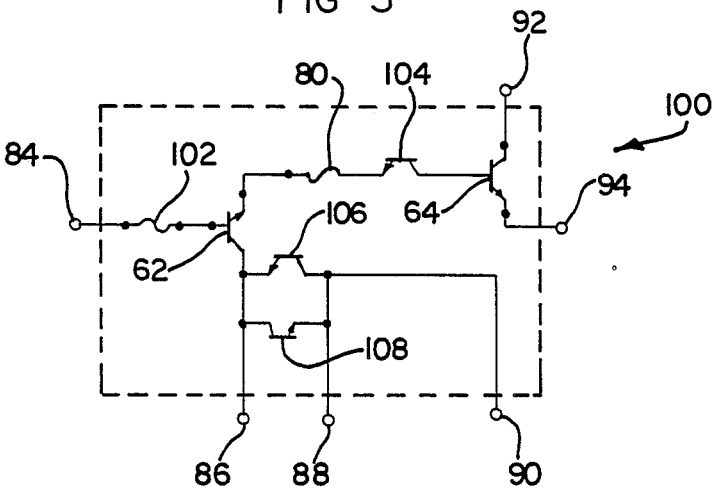

Referring now to FIG. 4, a further embodiment of a module in accordance with the second aspect of the invention is designated generally by reference numeral 100. This module 100 is similar to the module 60 shown in FIG. 3 except that the diode 78 is replaced by a further fusible link 102, a blocking element in the form of a transistor 104 is included in series with the fusible link 80, the diode 82 is replaced by a further transistor 106 and a further transistor 108 is included in parallel with the transistor 106. It will be noted that the transistors 104, 106 and 108 are utilised as two-terminal components, with only their emitters and collectors being utilised. In this form, they act as blocking components which break down when the voltage across them reaches a predetermined value, with a low resistance path being provided thereafter. The operation of the module 100 is similar to that of the module 60.

Figure 5:
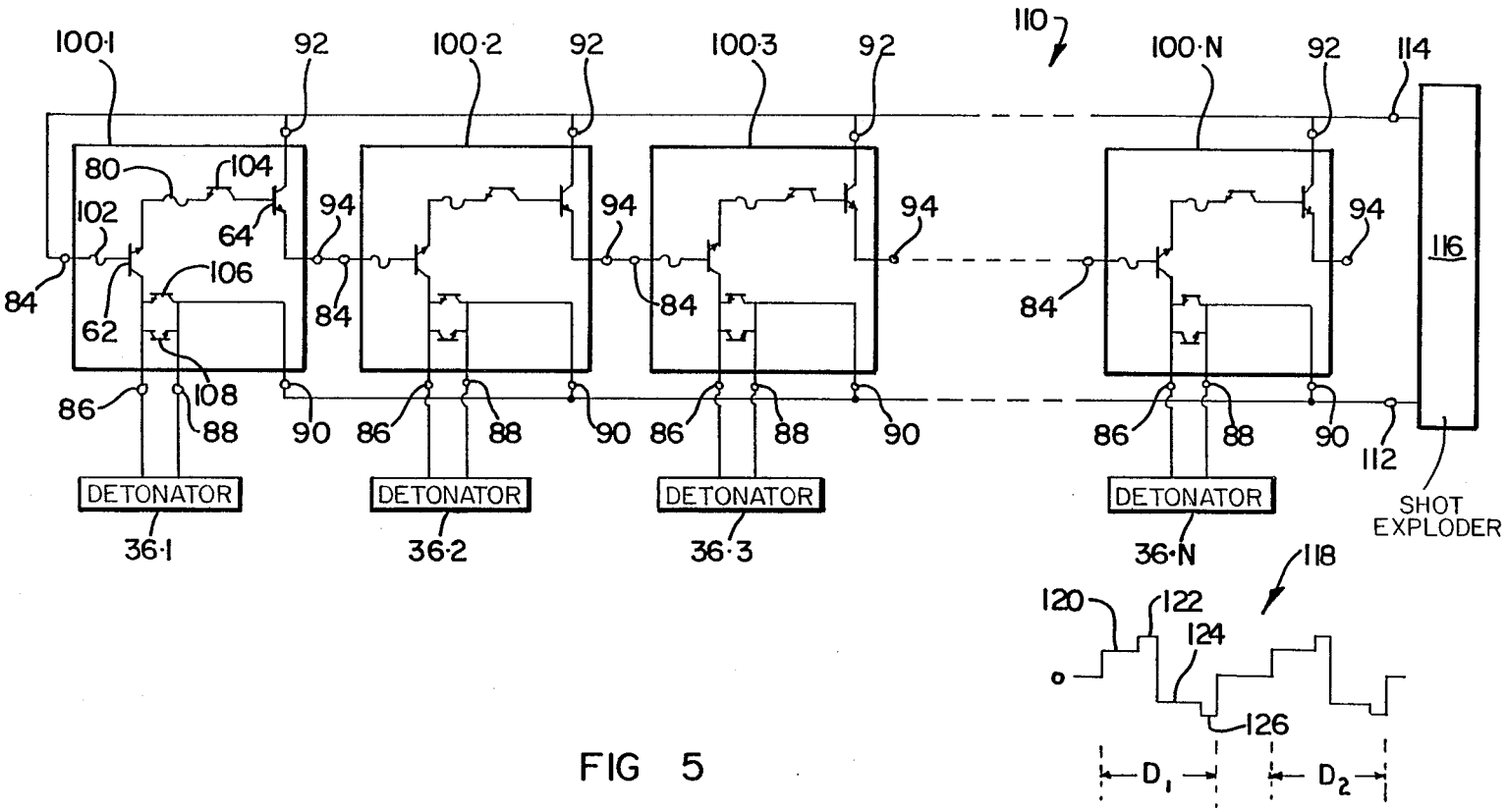
FIG. 5 shows schematically an electrically operable sequential activation system in accordance with the second aspect of the invention utilising modules such as shown in FIG. 4.

Referring finally to FIG. 5, a system in accordance with the second aspect of the invention is designated generally by reference numeral 110. The system 110 has a number of the modules 100, which are designated by reference numerals 100.1, 100,2, 100,3, up to 100.N. As indicated above, the output steering terminal of each module 100 is connected to the input steering terminal 84 of the next module. Further, the first power terminals 90 of the modules are all interconnected and also connected to a terminal 112 of a shot exploder 116. Similarly, the second power terminals 92 are interconnected and connected to a further terminal 114 of the shot exploder 116. The current pulses provided by the shot exploder 116 are shown at 118. Thus, the shot exploder 116 provides a first current pulse 120 which has the terminal 114 positive with respect to the terminal 112, a further pulse 122 of the same polarity and which is slightly greater in magnitude than the pulse 120, a further pulse 124 which is of opposite polarity and of the same magnitude to the pulse 120 and a subsequent pulse 126 which is of the same polarity as the pulse 124 and of slightly greater magnitude as with the pulse 122. These four pulses constitute a group and such a group is applied to each module to arm that module, activate its associated detonator and to thereafter isolate it. The detonators are numbered 36.1 to 36.N as with FIG. 2.

As shown in FIG. 5, the input steering terminal 84 of the first module 100.1 is connected to its second power terminal 92. Thus, as explained above, the first current pulse 120 flows through the link 102, the transistor 62 and the first power terminal 90 of the first module 100.1, passing through the first detonator 36.1 in doing so. This current pulse 120 forms a low resistance path between the base and collector of the transistor 62. The next current pulse 122 causes the link 102 to fuse, this current pulse 122 also passing through the transistor 62 and the first power terminal 90 of the first module 100.1. If the detonator 36.1 has already been fused before the pulse 122 arrives, the transistor 106 provides a bypass path for the current pulse 122.

The reverse polarity pulse 124 then flows from the first power terminal 90 of the first module 100.1, through the transistor 108, through the transistor 62, the link 80, the transistor 104 and from the base to the collector of the transistor 64 and out through the second power terminal 92. This current pulse 124 forms the low resistance path between the base and collector of the transistor 64. The current pulse 126 which is also of negative polarity and sightly larger in magnitude than the pulse 124 flows through the same path as pulse 124 and fuses the link 80. It will be appreciated that with the next group of pulses, the pulse 120 will flow through the transistor 64 of the first module 100.1 and then through the second module 100.2 in similar manner to that described above. This current pulse 120 of the next group is caused to flow through the next module 100.2 as the link 80 of the preceding module presents a high resistance value which isolates circuitry preceding the transistor 64 in question.

I claim:

1. An electrically operable sequential activation module for supplying an activating signal to a device which has a low resistance prior to being activated and a high resistance thereafter, the module being connectable in a series with other similar modules to sequentially activate a number of devices, the module including a first convertible element which has three terminals and in its normal first state has a high resistance in at least one direction between its first terminal and its second terminal and which changes to a second state in which it has a low resistance in both directions between its first and second terminals when a first signal having a predetermined characteristic is applied across the first and second terminals, the first element thereafter having the low resistance value in both directions between the first and second terminals when the first signal is removed and the first element further having in its normal first state a high resistance in at least one direction between its first terminal and its third terminal, the first element changing to a third state in which it has a low resistance in both directions between its first and third terminals when a second signal having a predetermined characteristic is applied across the first and third terminals, the first element thereafter having the low resistance value in both directions between the first and third terminals when the second signal is removed;

a first power terminal connectable to an electrical power source for supplying the first signal, the second signal and the activating signal;

a first and a second device terminal by means of which the device is connectable to the module;

an input steering terminal; and an output steering terminal which is connectable to the input steering terminal of a succeeding module in a series thereof;

with the first device terminal being connected to the input steering terminal;

the second device terminal being connected to the first terminal of the first element;

the second terminal of the first element being connected to the first power terminal; and the third terminal of the first element being connected to the output steering terminal.

2. The module claimed in claim 1, in which the first element has a low resistance from its first terminal to its second terminal and a high resistance in the opposite direction in its first state.

3. The module claimed in claim 1, in which the first element has a low resistance from its first terminal to its third terminal and a high resistance in the opposite direction in its first state.

4. The module claimed in claim 1, which includes a fusible link in series with either one of the device terminals, which is fusible by the activation signal.

5. The module claimed in claim 1, which includes a bypass element for passing the first signal to the first element if the device is not connected between the device terminals, the bypass element being connected between the device terminals.

6. The module claimed in claim 1, in which the first element is of a semi-conductor material.

7. The module claimed in claim 6, in which the first element has two junctions.

8. The module claimed in claim 7, in which the first element is a bi-polar transistor, the base terminal thereof comprising the first terminal.

9. An electrically operable sequential activation system, which includes a number of modules as claimed in any one of the preceding claims, arranged in a series with the input steering terminal of each module other than the first module being connected to the output steering terminal of the preceding module and with the modules being arranged in two groups, with the modules of the groups alternating, and with the first power terminals of the first group being interconnected, and with the first power terminals of the second group being interconnected.

10. The system claimed in claim 9, in which includes a device connected to the device terminals of each module in the series.

11. The system claimed in claim 9, which includes an electrical power source for supplying a series of groups of first, second and activating signals, the polarity of each group of signals reversing, the power source being connected between the first power terminals of the first and second group of modules.

12. The system claimed in claim 9, which the input steering terminal of the first module is connected to the first power terminal of the second module.

13. An electrically operably sequential activation module for supplying an activating signal to a device which has a low resistance prior to being activated and a high resistance thereafter, the module being connectable in a series with other similar modules to sequentially activate a number of devices, the module including a first convertible element which has three terminals and in its normal first state has a high resistance in at least one direction between its first terminal and its second terminal and which changes to a second state in which it has a low resistance in both directions between its first and second terminals when a first signal having a predetermined characteristic is applied across its first and second terminals, the first convertible element thereafter having the low resistance value in both directions between its first and second terminals when the first signal is removed and the first convertible element further having in its first state, a high resistance in at least one direction between its first terminal and its third terminal, the first convertible element changing to a third state in which it has a low resistance in both directions between its first and third terminals when a second signal having a predetermined characteristic is applied across its first and third terminals, the first convertible element thereafter having the low resistance value in both directions between its first and third terminals when the second signal is removed;

a second convertible element which also has three terminals and in its normal first state has a high resistance in at least one direction between its first terminal and its second terminal and which changes to a second state in which it has a low resistance in both directions between its first and second terminals when the second signal is also applied across its first and second terminals, the second convertible element thereafter having the low resistance value in both directions between its first and second terminals when the second signal is removed and the second convertible element further having in its first state a high resistance in at least one direction between its first terminal and its third terminal, the second convertible element changing to a third state in which it has a low resistance in both directions between its first and third terminals when a third signal having a predetermined characteristic is applied across its first and third terminals, the second convertible element thereafter having the low resistance value in both directions between its first and third terminals when the third signal is removed;

a first signal steering element for steering the second signal to the first and third terminals of the first element and to the first and second terminals of the second convertible element;

a second signal steering element for steering the third signal to the first and third terminals of the second convertible element;

a first bypass element for passing the second signal past a device that has been activated;

a first and second power terminal connectable to an electrical power source for supplying the first, second, third and activating signals;

a first and a second device terminal by means of which the device is connectable to the module;

an input steering terminal; and an output steering terminal which is connectable to the input steering terminal of a succeeding module in a series thereof; with the first signal steering element being connected between the input steering terminal and the first terminal of the first convertible element;

the first device terminal being connected to the second terminal of the first convertible element;

the second device terminal being connected to the first power terminal;

the first bypass element being connected between the first and second device terminals;

the second signal steering element being connected between the third terminal of the first convertible element and the first terminal of the second convertible element;

the second terminal of the second convertible element being connected to the second power terminal; and the third terminal of the second power terminal being connected to the output steering terminal.

14. The module claimed in claim 13, in which the first signal steering element is fusible such that it normally has a low resistance and is fused by the first signal to thereafter present a high resistance.

15. The module claimed in claim 13, in which the first signal steering element is unidirectional allowing a signal to pass in one direction only.

16. The module claimed in claim 13, in which the second signal steering element is fusible such that it normally has a low resistance and fused by the second signal to thereafter present a high resistance.

17. The module claimed in claim 13, in which the first bypass element is unidirectional allowing a signal to pass in one direction only.

18. The module claimed in claim 13, in which the first bypass element has a breakdown characteristic such that it allows a signal to pass if a predetermined voltage value is attained.

19. The module claimed in claim 13, which includes a blocking element connected in series with the second signal steering element for blocking the first signal from being supplied to the second convertible element.

20. The module claimed in claim 19, in which the blocking element has a breakdown characteristic such that it allows a signal to pass if a predetermined voltage is attained.

21. The module claimed in claim 13, in which the first convertible element has a low resistance from its first terminal to its second terminal and a high resistance in the opposite direction in its first state.

22. The module claimed in claim 13, in which the first convertible element has a low resistance from its first terminal to its third terminal and a high resistance in the opposite direction in its first state.

23. The module claimed in claim 13, in which the second convertible element has a low resistance from its first terminal to its second terminal and a high resistance in the opposite direction in its first state.

24. The module claimed in claim 13, in which the second convertible element has a low resistance from its first terminal to its third terminal and a high resistance in the opposite direction in its first state.

25. The module claimed in claim 13, which includes a second bypass element for passing the first signal to the first convertible element if the device is not connected between the device terminals, the second bypass element being connected between the device terminals in parallel with the first bypass element.

26. The module claimed in claim 25, in which the second bypass element has a breakdown characteristic such that it allows a signal to pass if a predetermined voltage is attained.

27. The module claimed in claim 13, in which the first and second convertible elements are of a semi-conductor material.

28. The module claimed in claim 27, in which the first and second convertible elements each have two junctions.

29. The module claimed in claim 28, in which both the first and the second convertible elements are bipolar transistors, the base terminals thereof comprising the respective first terminals.

30. An electrically operable sequential activation system which includes a plurality of modules as claimed in any one of claims 13 to 29 inclusive, arranged in a series with the first power terminals of the modules being interconnected, with the second power terminals of the modules being interconnected, and with the input steering terminal of each module other than the first module in the series being connected to the output steering terminal of the preceding module.

31. The system claimed in claim 30, which includes a device connected to the device terminals of each module in the series.

32. The system claimed in claim 30, which includes an electrical power source for supplying a series of groups of first, second and activating signals, the first signal of each group after the first constituting the third signal for a preceding group.

33. The system claimed in claim 30, in which the input steering terminal of the first module is connected to its second power terminal.

* * * * *